US005484640A

United States Patent [19]

Mullen et al.

[11] Patent Number: 5,484,640

[45] Date of Patent: Jan. 16, 1996

[54] HONEYCOMB STRUCTURE HAVING STIFFENING RIBS AND METHOD AND APPARATUS FOR MAKING SAME

[75] Inventors: Stephen J. Mullen, Beverly; Stanley F. Kench, III, Amesbury, both of Mass.

[73] Assignee: Eldim, Inc., Woburn, Mass.

[21] Appl. No.: 197,397

[22] Filed: Feb. 16, 1994

[51] Int. Cl.[6] ..... B32B 7/00; A01J 21/00; B31F 1/20

[52] U.S. Cl. ..... 428/119; 428/118; 428/120; 428/167; 428/182; 428/184; 428/192; 425/336; 264/286; 264/505

[58] Field of Search ..... 428/33, 116, 118, 428/182, 184, 167, 119, 120, 122, 179, 192; 264/286, 5.5, 287; 425/336, 304, 369

[56] References Cited

U.S. PATENT DOCUMENTS

| | | | |
|---|---|---|---|
| 1,000,758 | 8/1911 | Rude | 428/116 |
| 2,164,681 | 7/1939 | Fould | 189/34 |
| 3,144,881 | 8/1964 | Sproull | 138/117 |
| 3,200,489 | 8/1965 | Keeleric | 29/470.9 |
| 3,217,845 | 11/1965 | Reynolds et al. | 29/191 |
| 3,485,596 | 12/1969 | Alleaume | 29/183 |
| 3,486,700 | 12/1969 | Bristow | 239/590.5 |
| 3,529,693 | 9/1970 | Woodward et al. | 181/33 |
| 3,616,025 | 1/1971 | Fairbanks | 156/257 |
| 3,639,106 | 2/1972 | Yate | 29/191 |
| 3,932,232 | 1/1976 | Labuda et al. | 204/192 |
| 4,136,272 | 1/1979 | Rudd | 219/107 |
| 4,304,381 | 12/1981 | Lloyd | 248/179 |
| 4,471,013 | 9/1984 | Welzen | 428/116 |
| 4,478,174 | 10/1984 | Ranger | 118/718 |
| 4,668,443 | 5/1987 | Rye | 261/112 |
| 4,824,544 | 4/1989 | Mikalesen et al. | 204/298 |
| 4,830,723 | 5/1989 | Galvagni et al. | 204/192.17 |
| 4,854,263 | 8/1989 | Chang et al. | 118/715 |
| 4,962,622 | 10/1990 | Albrecht et al. | 52/630 |
| 5,089,137 | 2/1992 | McKown | 210/615 |
| 5,126,183 | 6/1992 | Smith | 428/118 |
| 5,140,940 | 8/1992 | Lindner | 118/724 |
| 5,171,412 | 12/1992 | Talieh et al. | 204/192.15 |
| 5,223,108 | 6/1993 | Hurwitt | 204/192.12 |

*Primary Examiner*—Donald J. Loney
*Attorney, Agent, or Firm*—Testa, Hurwitz & Thibeault

[57] ABSTRACT

An improvement in a corrugated strip having major flat sections which extend between longitudinal edges of the strip and which are joined along lateral edges by intermediate sections extending between the major flat sections, includes stiffening ribs protruding from the strip along at least one of the connected lateral edges of the major flat and intermediate sections, the stiffening ribs being oriented substantially perpendicularly to the lateral edges. Additionally, a method and apparatus for forming corrugated strips, including corrugated strips having stiffening ribs, includes structure for applying a force, through dies, to a strip of material along an axis which is oriented at an acute angle to the strip.

24 Claims, 5 Drawing Sheets

HONEYCOMB STRUCTURE HAVING STIFFENING RIBS AND METHOD AND APPARATUS FOR MAKING SAME

BACKGROUND OF THE INVENTION

The invention relates generally to the field of honeycomb assemblies. In particular, the invention pertains to honeycomb assemblies including corrugated ribbons having stiffening ribs, their method of manufacture, and apparatus for their manufacture.

Honeycomb material has come into increasing use in fields of application where both strength and light weight are important. Honeycomb assemblies commonly include a sandwich of two face sheets between which a cellular web is fixed to form a unitary structure. Typically, the web is fixed to the face sheets by welding, brazing, glueing or some other similar process. The cellular web is composed of hexagonal or otherwise shaped cells formed by joining similarly configured corrugated ribbons. The ribbons are laterally displaced with respect to one another to form webs, as with natural honeycomb. Various materials are used for both the face sheets and the corrugated ribbons depending upon the application, including steel, aluminum, stainless steel, titanium, papers, graphite composites, and various alloys, both common and exotic.

U.S. Pat. No. 4,632,862, describes a dramatically improved honeycomb structure. That patent pertains to an I-beam honeycomb structure in which conventional honeycomb, having corrugated ribbons arranged to define, for example, six sided cells, is further formed by centrally depressing the major flat surfaces of the corrugated ribbons to form parallel sub-flat surfaces. The sub-flat surfaces are connected to the major flat surfaces by side walls which are perpendicular to both the major flats and the sub flats. Joining two or more such corrugated ribbons with alternate ribbons inverted, by bonding sub-flats to sub-flats and major flats to major flats, produces a honeycomb web which incorporates I-beams extending end-to-end through the web. The I-beams provide a tremendous degree of strength not found in conventional honeycomb.

One difficulty encountered with the fabrication of honeycomb assemblies generally, and I-beam honeycomb assemblies in particular, stems from the need to consistently form the corrugated ribbons which form the assembly. This requires precisely controlling the lengths of the flat sections of the ribbons as well as the angles between adjacent flats. In the case of I-beam honeycomb, these tasks are complicated by the smaller angles to which the ribbon must be bent, which in turn results in smaller cells being formed in greater numbers.

A host of variables in the starting ribbon contributes to problems in consistently corrugating the ribbon. For example, the ability to form metal ribbon is affected by the ribbon's thickness, width, temper, yield strength, strain hardening factor, and metallurgical structure. Additionally, variables in the forming process and equipment affect corrugation as well. These variables include the inner and outer bend radii applied to the ribbon, punch or die clearances, the coefficients of friction between the tool and the ribbon, and the coining force applied to the ribbon. Tool wear, and loading rate affect the forming process as well.

Ribbons formed of titanium alloys have proven particularly difficult to corrugate because of their high yield strengths, strain hardening rates, and springback ratios. Springback occurs due to residual stresses in the regions of the ribbons which are bent during corrugation. These stresses are present in part because some of the material in the bent regions is deformed elastically while some of the material is deformed plastically. The material which is deformed elastically tries to "straighten out" the bends, while the material which is deformed plastically, and therefore strain-hardened, struggles to retain the bends. Consequently, the angles of corrugated ribbons formed of titanium alloys typically do not match those of the tools used to form them.

To reduce springback, forming tools should have an inner bend radius which is less than the thickness of the starting ribbon material. The edges of the tools, however, wear away quickly, particularly when forming ribbons made of high strength material such as stainless steel, inconel, and titanium. While springback can also be reduced by building forming equipment specific for each combination of cell shape, cell size, ribbon material, ribbon thickness, and ribbon width, this is not economically feasible. For example, 280 sets of tooling would be required to make separate tooling to form each iteration of honeycomb ribbon, in 0.001" increments, from 0.002" to 0.015 thick", in each of four different cell shapes, and in each of five different cell sizes.

Accordingly, it is an object of the invention to provide a honeycomb assembly having a more consistent cell shape than known honeycomb structures. Another object of the invention is to provide a method of manufacturing such a structure. Still another object of the invention is to provide an apparatus for manufacturing such a structure.

SUMMARY OF THE INVENTION

These and other objects are achieved by the present invention which in one aspect features a corrugated strip having major flat sections which extend between longitudinal edges of the strip. The major flat sections are joined along lateral edges by intermediate sections extending between the major flat sections. The strip includes the improvement of stiffening ribs which protrude from the corrugated strip along at least one of the connected lateral edges of the major flat and intermediate sections. The stiffening ribs are oriented substantially perpendicularly to the lateral edges.

In some embodiments of this aspect of the invention, series of stiffening ribs protrude from the corrugated strip along each of the connected lateral edges of the major flat and intermediate sections. Alternating series of stiffening ribs may protrude from opposed surfaces of the corrugated strip. This feature of the invention allows two corrugated strips to be snugly arranged back to back for the formation of a honeycomb assembly.

In some embodiments of this aspect the invention, each of the major flat sections of the corrugated strip includes a central depressed section forming a matching sub-flat section. The matching sub-flat section is parallel to and connected to the major flat section by sidewalls. A plurality of such strips can be used for the formation of an I-beam honeycomb assembly as discussed above. In accordance with the invention, stiffening ribs protrude from the corrugated strip along at least one of the lateral edges between the major flat sections and the sidewalls.

In some embodiments of this aspect of the invention, an I-beam honeycomb structure is provided including a series of stiffening ribs protruding from the corrugated strip along each of the connected lateral edges between the major flat and intermediate sections, the major flat sections and the sidewalls, and the sidewalls and sub-flat sections. The strips may be formed so that alternating pairs of series of stiffening ribs protrude from opposed surfaces of the strip.

In another aspect, the invention features a honeycomb structure constructed by arranging at least two of the above-described corrugated strips adjacent one another. The strips are displaced with respect to one another so that the major flat sections of the strips abut each other. The major flat sections are then joined together such as by welding, brazing, or some other technique. The assembly may further include face sheets fixed to the ends of the corrugated strip to provide a sandwich-type structure.

In another aspect, the invention features a method for making a corrugated strip. The method includes the steps of providing a strip of plastically deformable material and forming in the strip a plurality of major flat sections extending between longitudinal edges of the strip. As noted above, the major flat sections are joined along lateral edges by intermediate sections extending between the major flat sections. The method of the invention includes the further step of forming along at least one of the connected lateral edges of the major flat and intermediate sections, stiffening ribs which protrude from the corrugated strip. The stiffening ribs are oriented substantially perpendically to the lateral edges. Some embodiments of this aspect of the invention feature the step of forming alternating pairs of series of stiffening ribs to protrude from opposed surfaces of the corrugated strip along each of the connected lateral edges of the major flat and intermediate sections.

In another aspect, the invention features a method for making a corrugated strip including the steps of feeding a substantially planar strip of plastically deformable material along a longitudinal axis and imparting on the strip a force to form a series of major flat sections which extend between longitudinal edges of the strip. The major flat sections are joined along lateral edges by intermediate sections extending between the major flat sections. A significant feature of this aspect of the invention is that the force imparted on the strip to form the major flat sections is directed parallel to an axis which is oriented at a acute angle to the plane of the strip. Imparting the force in this way facilitates the formation of the stiffening ribs as set forth above.

Still another aspect of the invention features an apparatus for making a corrugated strip by imparting a force to the strip at an acute angle to the strip. The apparatus includes upper and lower dies which define interfitting surfaces, and actuating means for moving the dies in a direction parallel to an axis oriented at an acute angle to the plane of the strip, as well as perpendicularly to the strip. The strip is fed between the interfitting surfaces of the dies.

Other objects, features, and advantages of the invention will be more fully appreciated by reference to the following detailed description which is to be read in conjunction with the attached drawings.

DETAILED DESCRIPTION

As noted above, in one aspect the invention features a corrugated strip including the improvement of stiffening ribs protruding from the strip along at least one of the lateral edges of the strip where major flat and intermediate sections meet. The stiffening ribs are oriented substantially perpendically to the lateral edges, and serve to "lock" the angle between adjoining major flat and intermediate sections. Using multiple strips having such stiffening ribs to form a honeycomb structure provides a structure having improved consistency of cell size and configuration.

Figure 1:
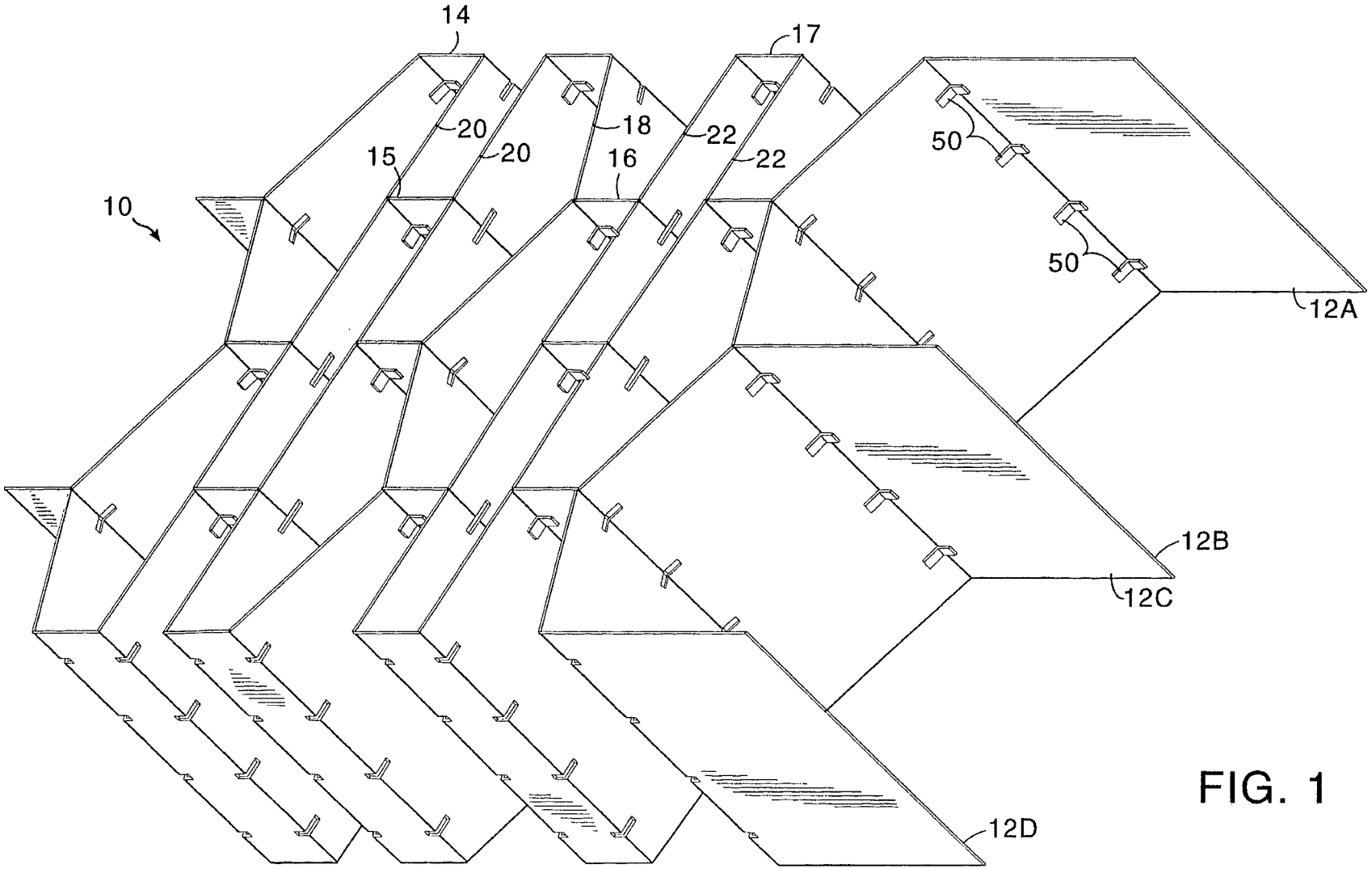
FIG. 1 is a perspective view of a honeycomb structure formed with corrugated strips including the stiffening ribs of the invention.

Such a honeycomb structure is shown in FIG. 1 which is formed of corrugated strips 12A, 12B, 12C, and 12D. While offset with respect to one another to form the structure 10, the corrugated strips 12A, 12B, 12C, and 12D are similarly configured. For simplicity sake, therefore, the geometry of only one of the strips will be described with detail herein.

The corrugated strip 12A includes a major flat section 14 connected to a parallel flat section 16 by an intermediate section 18. Each of the flat sections 14 and 16 has its central section depressed to form parallel subflat sections 15 and 17. Walls 20 and 22 join the flat and subflat-sections and are parallel to one another and perpendicular to the flat and subflat sections 14 and 16. The practice of the invention, however, is not restricted to strips having such sub flat sections. Rather, the concepts of the invention may be applied to a variety of corrugated strip sizes and configurations, including those which are generally known.

The strips, such as strips 12A and 12B, are displaced with respect to one another so that the undepressed portions of the flat sections of adjacent strips as well as the subflat surfaces of adjacent strips abut one another. The abutting surfaces are then welded, brazed, or otherwise sealed together to form a the honeycomb structure 10.

The corrugated strips of the invention further include stiffening ribs 50 which protrude from the corrugated strips along the lateral edges between the various sections of the strip. For example, in the case of corrugated strip 12A, stiffening ribs 50 protrude from the strip 12A along the lateral edges 52 between the undepressed portions of the flat section 14 and 16 and the sidewalls 20 and 22. The ribs also protrude from the strip along the lateral edges 54 between the intermediate section 18 and the undepressed portions of the flat sections 14 and 16. The stiffening ribs 50 can be said to belong to series, there being one series of stiffening ribs 50 associated with each lateral edge of the strip 12A. While the honeycomb structure 10 includes a series of stiffening ribs along all of the depicted lateral edges, various structures may be formed in accordance with the invention which include stiffening ribs along only some or even one of the lateral edges. Additionally, each series of stiffening ribs may include anywhere from one to many individual stiffening ribs.

Figure 2:
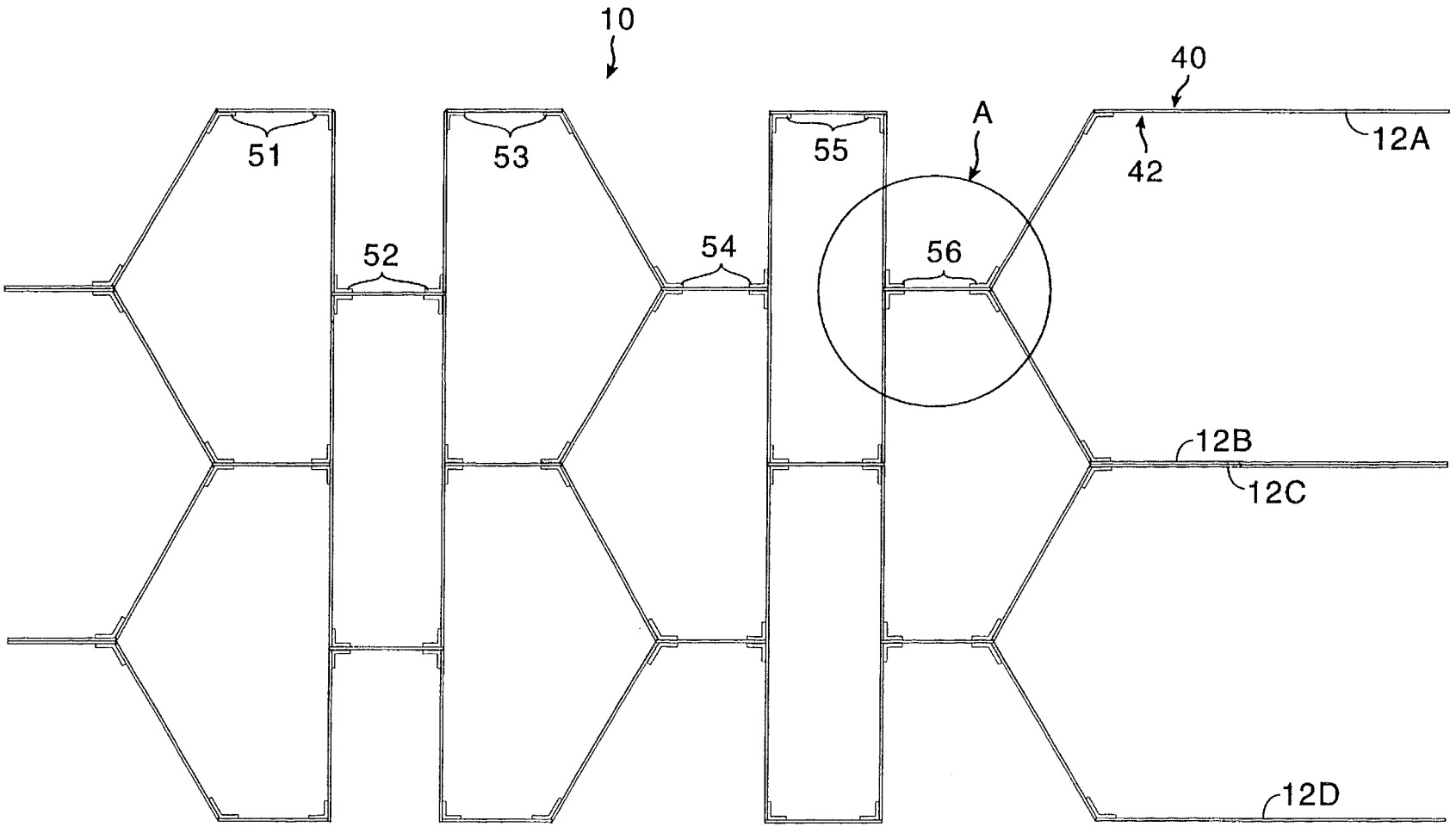
FIG. 2 is an elevation view of part of the structure shown in FIG. 1.

The structure 10 is further depicted in FIG. 2 which is an elevational view looking in a direction parallel to the lateral edges of the corrugated strips forming the structure. For each series of stiffening ribs formed in the structure 10, only one stiffening rib is visible. In the case of strip 12A, for example, pairs of stiffening ribs 51, 52, 53, 54, 55, and 56 can be seen. Alternating pairs of series of stiffening ribs protrude from opposed sides of the corrugated strip 12A. That is, stiffening rib pairs 51, 53, and 55 protrude from surface 42 of the strip 12A and stiffening rib pairs 52, 54 and 56 protrude from surface 40 of the corrugated strip 12A. Likewise, the series of stiffening ribs formed in corrugated strips 12B, 12C, and 12D protrude from opposed surfaces of those strips in an alternating pairs fashion. This enables the structure 10 to be assembled with a plurality of corrugated strips which are arranged back to back and which fit together snuggly. As a result, in the case of the I-beam honeycomb structure shown in FIG. 2, for example, a large portion of the subflat surfaces of adjacent corrugated strips, as well as large portions of the undepressed portions of the flat sections of adjacent strips abut one another. This facilitates the welding, brazing, or other method used for joining adjacent strips and thereby improves the overall strength of the structure 10.

Figure 3:
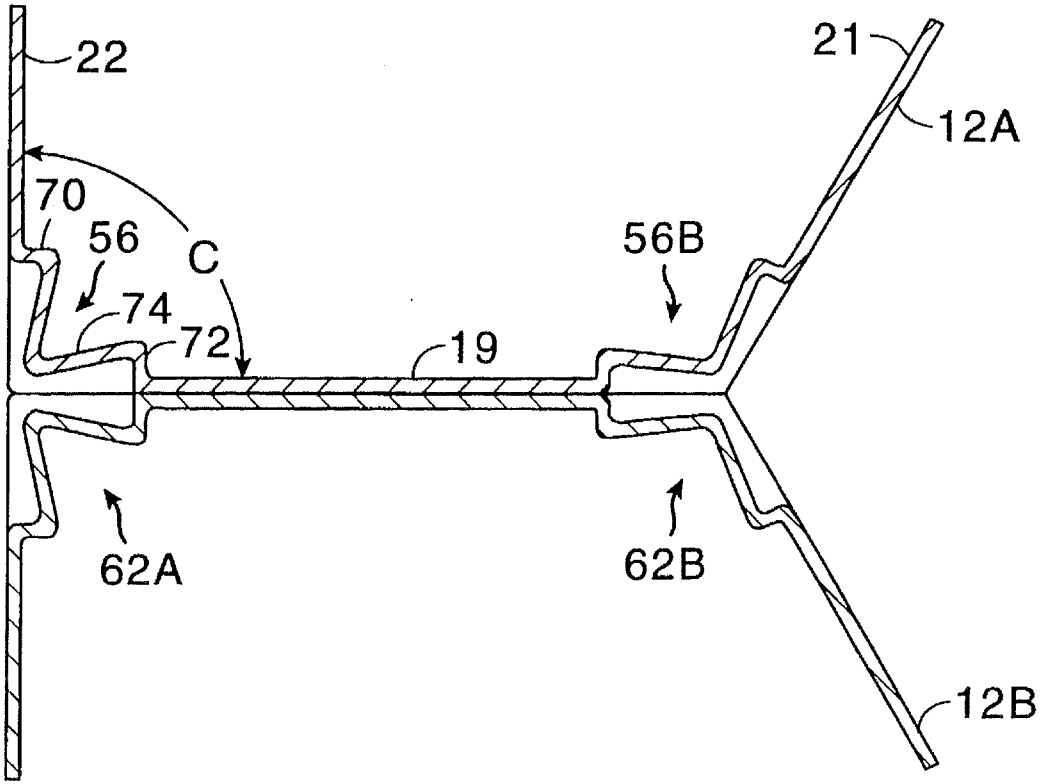
FIG. 3 is an enlarged, cross-sectional view of area A of the structure shown and FIG. 2.

An enlarged cross sectional view is shown in FIG. 3 which depicts portions of the corrugated strips 12A and 12B including pairs of stiffening ribs 56A, 56B, 62A, and 62B. Notably, the stiffening ribs are small in relation to the sections of the corrugated strips in which they are formed—namely, sidewall 22, undepressed flat section 19, and intermediate section 21. The relatively small area of the stiffening ribs and the sharp bend angles of which they are formed, results in high local forming pressures which plastically deforms the material of the corrugated strip. This results in the stiffening ribs being rigid and strain hardened which serves to lock the angles between the sections of the corrugated strip regardless of the springback forces which remain in effect in those angles. Consequently, these stiffening ribs enable, for example, titanium to be shaped into a consistently corrugated strip, even for bend angles of 90 degrees and smaller, such as are required in many honeycomb core structures.

The geometry of the ribs can be varied to counterbalance the springback forces which are present in the main bends of the corrugated strips. Take for example, stiffening rib 56A which includes end walls 70 and 72 joined by main wall 74. The end walls 70 and 72 are formed at substantially right angles to sidewall 22 and undepressed flat section 19. These right-angled sidewalls, together with the sharp bend in main wall 74, resist the tendancy of the main angle C between sidewall 22 and undepressed flat section 19 to vary. In cases where the angle C is not so severe, the stiffening ribs may be formed with a main wall having a bend less sharp than main wall 74, and the side walls may not need to be oriented at right angles to the adjacent walls.

One benefit of this improved consistency of cell shape and size is the facilitation of automated methods and apparatus for joining together adjacent strips, such as corrugated strips 12A and 12B. This is because where the strips are welded or similarly secured together, a welding shoe or horn is inserted into each of the cells. When cell shape varies, the welding shoe or horn is not easily inserted into and withdrawn from the honeycomb cells, which results in an inefficient fabrication process. By providing consistently formed corrugated strips through use of the invention, therefore, automated methods and apparatus for forming honeycomb structures can be employed to great cost savings.

Another advantage of the stiffening ribs of the invention is the provision of a honeycomb structure having improved compression and shear strengths. This stems from the stiffening ribs locking the angles between the various section of the corrugated strips, and thereby prevent cell deformation under stress. By preserving the integrety of the individual cells, the stiffening ribs preserve the integrity of the overall structure.

Figure 4:
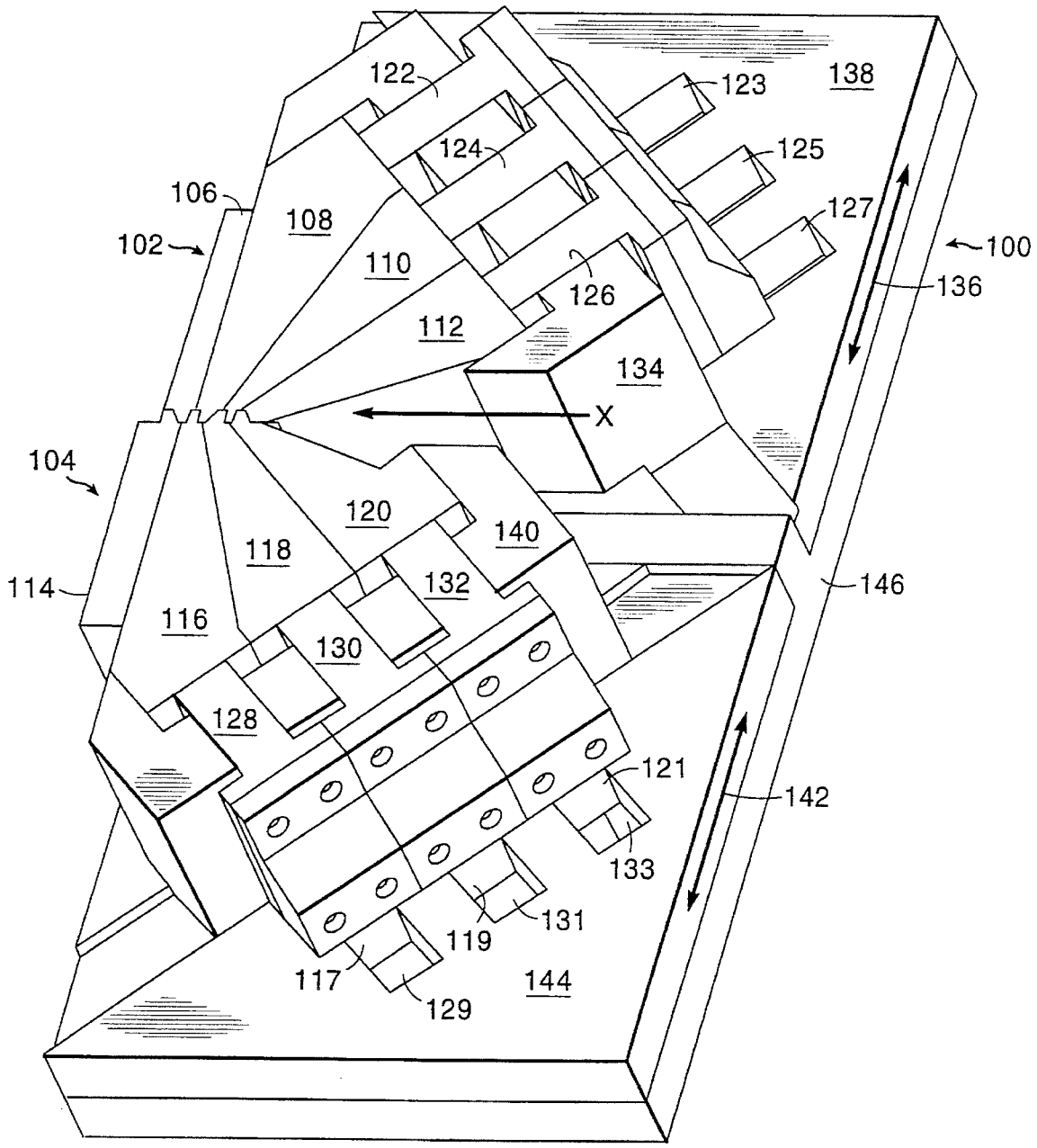
FIG. 4 is a schematic, perspective view of an apparatus in accordance with the invention and suitable for making, for example, the corrugated strips used to make the honeycomb structure shown in FIG. 1.

FIG. 4 shows an apparatus 100 for forming corrugated strips, such as those described above in accordance with one aspect of the invention. The apparatus 100, however, may be used for the corrugation of a variety of honeycomb component strips, including many of which are generally known. The apparatus 100 includes an upper die assembly 102 and a lower die assembly 104. The upper die assembly includes a clamp 106 and dies 108, 110 and 112. The lower die assembly includes a clamp 114 and dies 116, 118 and 120. The dies 108, 110 and 112 are driven by actuators 122, 124 and 126. The dies 116, 118 and 120 are driven by actuators 128, 130 and 132. The actuators of both the upper and lower die assemblies may be controlled by stepping motors, solenoids, or similar mechanism (not shown) such as are ordinarily known. The actuators of the upper die assembly 102 are guided by guiding structure 134 which is mounted to a platen 138. The actuators of the lower die assembly 104 are guided by guiding structure 140 which is mounted to a platen 144. The platens 138 and 134 are supported by a base 146 and can slide relative to the base 146 in the direction of arrows 136 and 142.

The actuators 122, 124 and 126 are driven by journals or similar structures (not shown). The journals travel in channels 123, 125 and 127 which are defined by the platen 138. These channels are oriented at an acute angle to an axis X. Similarly, the actuators 128, 130 and 132 are driven by journals or similar structures 117, 119, and 121 which travel in channels 129, 131 and 133 defined by the platen 144. The channels 129, 131 and 133 are oriented perpendicularly to the channels 123, 125, and 127. This arrangement of dies, guide blocks, journals and channels enables each of the dies of both the upper and lower die assemblies to be actuated through a stroke oriented at an angle to an axis X. The platens 138 and 144 being movable relative to the base 146 enables the dies to be actuated perpendicularly to the axis X.

Axis X designates the axis along which a strip of material (not shown) is fed between the die assemblies for corrugation. The dies being actuatable at an acute angle to axis X facilitates the formation of the stiffening ribs described above. This is because were the dies to move only perpendicularly to the axis X, and thereby perpendicularly to the strip of material being corrugated, the dies would need to form portions of the stiffening ribs, such as the stiffening rib sidewalls described above, to protrude perpendicularly to the stroke of the dies. This would present numerous difficulties which would inevitably result in poorly formed, and hence less effective, stiffening ribs. By angling the stroke of the dies with respect to the axis X, however, the dies may punch out the stiffening ribs in a typical manner, which enables the dies to form consistently sized and configured stiffening ribs.

In applications where the apparatus 100 is used for the formation of corrugated strips having stiffening ribs, the ends of the dies of the upper and lower die assemblies which face one another, and between which a strip of material passes for corrugation, include raised or depressed portions corresponding to the stiffening ribs to be formed. So-configured dies will be readily apparent to those skilled in the art and are not, therefore, described in detail herein.

Figure 5:
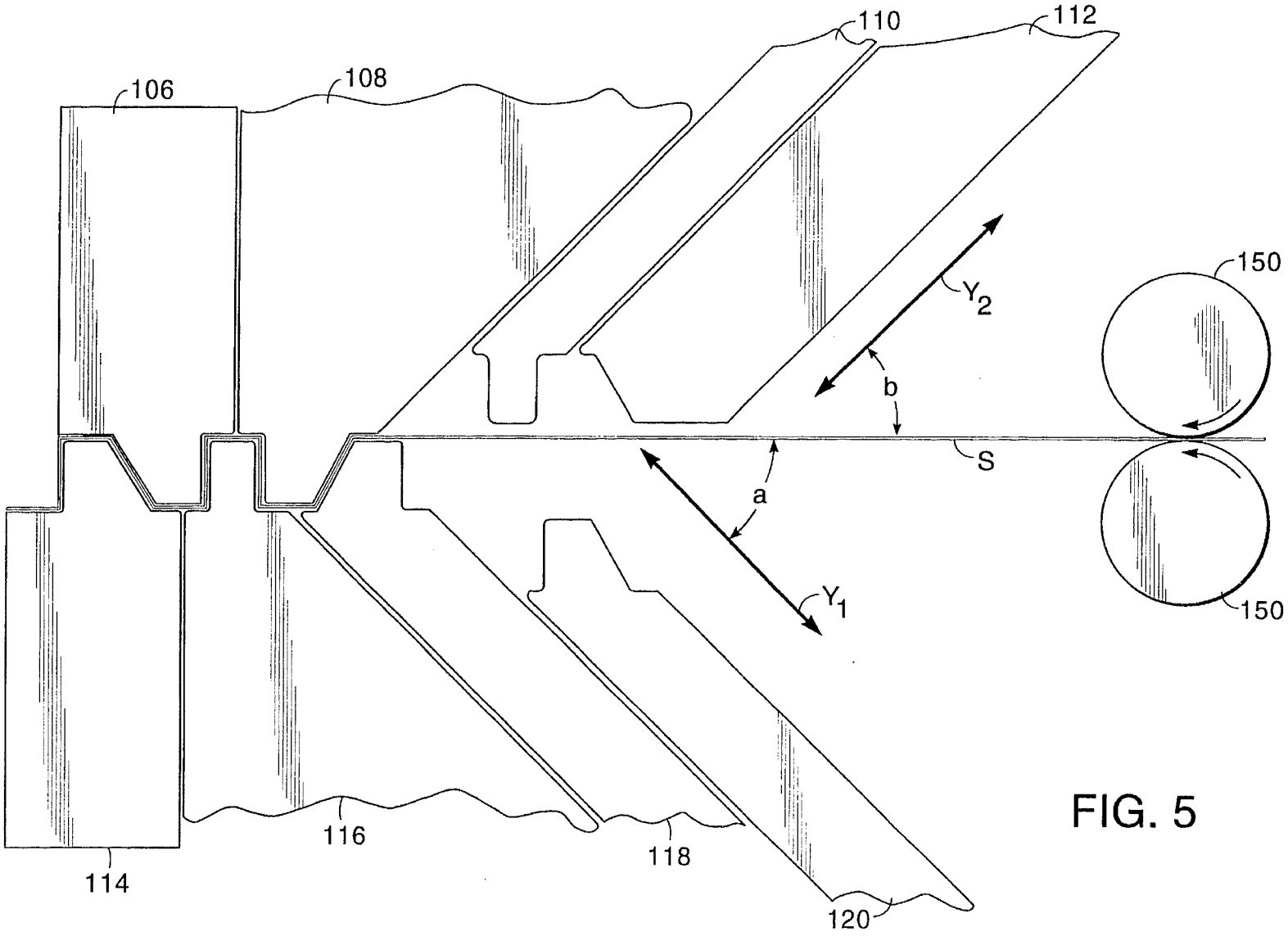
FIG. 5 is a partial, schematic view of the apparatus shown in FIG. 4.

A schematic representation of part of the apparatus 100 in operation is shown in FIG. 5 wherein a strip of material S is held in place by clamps 106 and 114. After the Strip S is secured by the clamps 106 and 114, dies from the lower and upper die assemblies are brought into contact with the strip S, in an interfitting fashion, to corrugate the strip S as discussed above. Namely, die 116 is first brought into engagement with the strip S against the clamps 106 and 114. Then, die 108 is actuated toward the strip S and interfits with the die 116. This is followed, in order, by dies 118, 110, 120, and 112 being brought into engagement with the strip S.

Through the use of the guiding structures 140 and the channels 117, 119, and 191 as discussed above, dies 116, 118, and 120 are brought into engagement with the strip S in a direction parallel to axis $Y_1$. This axis $Y_1$ is oriented at an acute angle "a" to the strip S. Similarly, the guiding structure 134 and the channels 123, 125, and 127 are used to bring the dies 108, 110 and 112 into engagement with strip S along a path which is parallel to axis $Y_2$. Axis $Y_2$ is oriented at an acute angle "b" to the strip S and perpendicularly to axis $Y_1$. As noted above, actuating the dies in this manner, as opposed to perpendicularly to the strip S as is traditional, enables more effective formation of the stiffening ribs of the invention.

After the dies have been brought into engagement with the strip S and a portion of the strip S is, therefore, corrugated, platens 138 and 144 are moved relative to the base 146 so that the dies and the clamps are withdrawn from the strip S in a direction which is perpendicular to the strip S. This is done because the now-formed corrugations in the strip S would prevent the dies from being withdrawn along the axes of their approaching stroke. Once the dies and clamps have been withdrawn, the strip S is advanced such as by rollers 150 so that the rearmost corrugations can be engaged by the clamps 106 and 114. This leaves an uncorrugated section of the strip S arranged between the upper and lower die assemblies 102 and 104. The above-described corrugation process is then repeated whereby the dies 116, 108, 118, 110, 120, and 112 are actuated, in sequence, into engagement with the strip S to form corrugations.

While the apparatus 100 is particularly well suited for forming the above-described corrugated strips having stiffening ribs, the apparatus 100 can also be used for forming corrugated strips of various other sizes and geometries, including many which are known. Accordingly, the apparatus 100 should not be interpreted as being restricted to the formation of any particular type of corrugated strip.

Furthermore, while various embodiments of the several aspects of the invention have been set forth with particularity above, other variations to the invention will be readily apparent to those skilled in the art. The invention is to be defined, therefore, not by the preceding detailed description, which is intended as illustrative, but by the claims which follow.

What is claimed is:

1. A corrugated strip comprising major flat sections which extend between longitudinal edges of the strip and which are joined along lateral edges by intermediate sections extending between the major flat sections, the the adjoining lateral edges of the major flat sections and the intermediate sections defining ridges of the corrugated strip; and stiffening ribs protruding from the corrugated strip along at least one of the ridges formed by the adjoining lateral edges of the major flat and intermediate sections, the stiffening ribs being oriented substantially perpendicularly to the lateral edges and serving to lock the angle of the ridge.

2. A corrugated strip as set forth in claim 1 wherein a series of stiffening ribs protrudes from the corrugated strip along each of the angled sections formed by the connected lateral edges of the major flat and intermediate sections.

3. A corrugated strip as set forth in claim 2 wherein alternating pairs of series of stiffening ribs protrude from opposed surfaces of the corrugated strip.

4. A corrugated strip as set forth in claim 1 wherein each of the major flat sections includes a central depressed section forming a matching sub-flat section which is parallel to and connected to the major flat section by sidewalls, thereby defining at least two corners of a depressed portion of the corrugated strip, and the stiffening ribs protrude from the corrugated strips along at least one of the corners defined by the lateral edges between the major flat sections and the sidewalls.

5. A corrugated strip as set forth in claim 4 wherein the improvement further comprises stiffening ribs protruding from the corrugated strip along at least one of the ridges formed by the lateral edges between the sidewalls and the sub-flat sections.

6. A corrugated strip as set forth in claim 5 wherein a series of stiffening ribs protrudes from the corrugated strip along each of the connected lateral edges forming ridges between the major flat and intermediate sections, the major flat sections, respectively and the sidewalls, and the sidewalls and the sub-flat sections.

7. A corrugated strip as set forth in claim 6 wherein alternating pairs of series of stiffening ribs protrude from opposed surfaces of the corrugated strip.

8. A honeycomb structure comprising at least two corrugated strips as set forth in claim 3 arranged adjacent one another and displaced with respect to one another so that the major flat sections of the strips abut each other and are joined together.

9. A honeycomb structure comprising at least two corrugated strips as set forth in claim 7 arranged adjacent one another and displaced with respect to one another so that the major flat sections of the strips abut each other, the undepressed portions of the major flat sections of the strips being joined together and the sub-flat sections being joined together whereby a series of I-beams are formed.

10. A method for making a corrugated strip, the method comprising the steps of providing a strip of plastically deformable material, forming in the strip a plurality of major flat sections extending between longitudinal edges of the strip and joined along lateral edges by intermediate sections extending between the major flat sections, adjoining lateral edges of the major flat sections and the intermediate sections defining ridges of the corrugated strip, and forming along at least one of the ridges defined by the adjoining lateral edges of the major flat and intermediate sections, stiffening ribs protruding from the corrugated strip and oriented substantially perpendicularly to the lateral edges.

11. A method as set forth in claim 10 wherein the step of forming stiffening ribs in the corrugated strip includes forming a series of stiffening ribs along each of the ridges formed by the connected lateral edges of the major flat and intermediate sections.

12. A method as set forth in claim 11 wherein the step of forming stiffening ribs in the corrugated strip includes forming alternating pairs of series of stiffening ribs to protrude from opposed surfaces of the corrugated strip.

13. A method as set forth in claim 10 further comprising the steps of forming in each of the flat sections a central depressed sub-flat section which is parallel to and connected to the major flat section by sidewalls, thereby defining at least two corners of a depressed portion, and forming along at least one of the corners formed by the lateral edges between the major flat sections and the sidewalls, stiffening ribs protruding from the corrugated strip.

14. A method as set forth in claim 13 wherein the step of forming stiffening ribs in the corrugated strip includes forming stiffening ribs along at least one of the ridges formed by the lateral edges between the sidewalls and the sub-flat sections.

15. A method as set forth in claim 14 wherein the step of forming stiffening ribs in the corrugated strip includes forming a series of stiffening ribs along each of the ridges formed by the connected lateral edges between the major flat and intermediate sections, the major flat sections and the sidewalls, and the sidewalls and the sub-flat sections, respectively.

16. A method as set forth in claim 15 wherein the step of forming stiffening ribs in the corrugated strip includes forming alternating pairs of series of stiffening ribs to protrude from opposed surfaces of the corrugated strip.

17. A method for making a corrugated strip, the method comprising the steps of feeding a substantially planar strip of plastically deformable material along a longitudinal axis, imparting on the strip a force directed along an axis oriented at an acute angle to the plane of the strip to form a series of major flat sections which extend between longitudinal edges of the strip and which are joined along lateral edges by intermediate sections extending between the major flat sections, adjoining lateral edges forming ridges of the strip, and forming along at least one of the ridges of the corrugated strip stiffening ribs which are oriented substantially perpendicularly to the ridge.

18. A method as set forth in claim 17 further including the step of displacing the strip along the longitudinal axis after the formation of the series of major flat sections.

19. A method as set forth in claim 17 wherein the step of imparting a force on the strip is carried out utilizing a die.

20. A method as set forth in claim 19 wherein the step of imparting a force on the strip is carried out utilizing a plurality of dies.

21. A method as set forth in claim 20 comprising the further step of, after imparting a force on the strip, withdrawing the dies away from the strip perpendicularly to the plane of the strip.

22. An apparatus for making a corrugated strip, the apparatus comprising feeding means for moving a substantially planar strip of plastically deformable material along a longitudinal axis, upper and lower dies defining interfitting surfaces, the dies being slidably supported opposite one another to define a space between the interfitting surfaces through which the feeding means moves the strip, actuating means for moving the upper and lower dies in a direction parallel to a first axis which is oriented at an acute angle to the plane of the strip and for imparting a force to the strip through the dies to corrugate the strip such that a series of major flat sections and intermediate sections are formed which are connected along lateral edges, adjoining lateral edges forming ridges of the strips, and means associated with the interfitting surfaces of the upper and lower dies for forming stiffening ribs in the strip along at least one of the ridges, the stiffening ribs being oriented substantially perpendicularly to the ridges.

23. An apparatus as set forth in claim 22 further comprising withdrawing means for moving the upper and lower dies in a direction parallel to a second axis which is oriented perpendicularly to the plane of the strip.

24. An apparatus as set forth in claim 22 wherein each of the upper and lower dies comprises a plurality of dies movable relative to one another parallel to the first axis.

* * * * *